United States Patent [19]

Itou et al.

[11] 4,320,370

[45] Mar. 16, 1982

[54] THERMO-SENSITIVE REED SWITCH

[75] Inventors: Tomio Itou, Ichikawa; Toshiyuki Kitagawa, Chiba, both of Japan

[73] Assignee: TDK Electronics Company, Ltd., Tokyo, Japan

[21] Appl. No.: 144,599

[22] Filed: Apr. 28, 1980

Related U.S. Application Data

[63] Continuation of Ser. No. 943,156, Sep. 18, 1978, abandoned.

[30] Foreign Application Priority Data

Nov. 7, 1977 [JP] Japan ..... 52-149282

[51] Int. Cl.[3] ..... H01H 37/58

[52] U.S. Cl. ..... 335/208; 335/146

[58] Field of Search ..... 335/208, 146, 301, 217

[56] References Cited

U.S. PATENT DOCUMENTS 3,903,492 9/1975 Endo et al. ..... 335/208

*Primary Examiner*—Harold Broome

*Attorney, Agent, or Firm*—Robert Scobey

[57] ABSTRACT

A thermo-sensitive reed switch in which the thermo-sensitive magnetic element is slit parallel to the reeds in the element.

6 Claims, 8 Drawing Figures

THERMO-SENSITIVE REED SWITCH

This is a continuation, of application Ser. No. 943,156 filed Sept. 18, 1978 now abandoned.

BACKGROUND AND BRIEF DESCRIPTION OF THE INVENTION

This invention relates to a thermo-sensitive reed switch having permanent magnets as the source of magnetic flux to be varied with temperature, the magnetic flux therefrom being controlled in such a way as to change the intensity and distribution of the magnetic field acting on the switch element by a thermo-sensitive magnetic element whose saturation flux density falls with rising temperature and, in the neighborhood of its Curie temperature, drops sharply to turn the magnetic element into a paramagnetic state, thereby actuating the contact points of the switch element to close and open in on-off manner.

A thermo-sensitive reed switch uses, as its switch element, a glass tube hermetically containing the contact part. Because of this construction, the switch is more durable than bi-metal switches in terms of contact point wear and switch aging, and is therefore more reliable. Notwithstanding this advantage, its temperature hysteresis, that is, the difference between operating or opening temperature and resetting or closing temperature is small as compared with those of temperature switches of bi-metal and liquid expansion types. Small temperature hysteresis implies higher accuracy of response to controlling temperature, but is likely to result in a switch repeating the cycle of closing and opening actions with a higher frequency, leading to wear of contact points, changing of contact resistance and, eventually, giving rise to such operating difficulties as contact point fusion or imperfect contact point separation. Because of these drawbacks and advantages of thermo-sensitive reed switches in general, switches having such large temperature hysteresis as will minimize the on-off frequency within the allowable range of control temperature variation have come to be preferred. Such reed switches last long in service.

Reed switches such as those proposed in Japanese utility model application No. SHO 51-26279, published July 3, 1976 (SHOWA 51), have been developed to meet this need for long-life thermo-sensitive reed switches, but production of such switches has been found to involve a problem in that, the larger the temperature hysteresis, the greater the variation among produced switches of the temperature levels at which opening and closing actions take place.

The present invention is directed to an improvement of reed switches of the type shown in the Japanese utility model application cited above. In particular, the thermo-sensitive magnetic element is slit, preferably parallel to the reeds in the element, thereby greatly improving performance.

The object of this invention is to provide a reed switch with large temperature hysteresis, whose operating temperature can be brought closer to a specified level to assure a high degree of product uniformity with a range of dAT values that are readily available.

The invention will be more completely understood by reference to the following detailed description.

DETAILED DESCRIPTION

Figure 1:
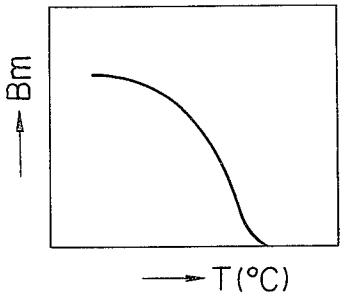
FIG. 1 is a curve showing the variation in magnetic property of a thermo-sensitive ferrite material with temperature.

Given the state of the art, the present invention proceeded from the basic principles of the thermo-sensitive reed switch and temperature hysteresis as represented in FIGS. 1 to 4. FIG. 1 shows the relationship between saturation flux density and temperature of a thermo-sensitive ferrite used as the material of the thermo-sensitive magnetic element. It will be seen in FIG. 1 that, with rising temperature, saturation flux density decreases, and near its Curie temperature drops sharply, and that this characteristic is reproducible since falling temperature raises saturation flux density in the same but reversed manner.

Figure 2:
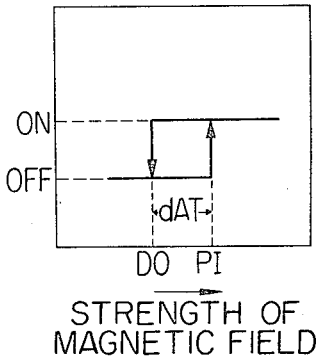
FIG. 2 is a curve showing the AT characteristic of the switching action of a reed switch element.

FIG. 2 refers to the same ferrite and indicates the ampere-turn (hereinafter abbreviated AT) characteristic of the switching action on the basis of magnetic field being applied to the switch element in the direction of and along the length of the reeds inside thereof. The level of increasing field intensity at which the switch changes its state from "off" to "on" is termed the "pull-in AT" (hereafter called PI), and the level of decreasing field intensity at which the switch changes its state from "on" to "off" is termed the "drop-out AT" (hereafter called DO). Field intensity on the decrease maintains the switch in closed or "on" condition until DO is reached, and conversely, the intensity on the increase maintains the switch in open or "off" condition until PI is reached. The difference between PI and DO is termed the "differential ampere-turns" (hereafter abbreviated as dAT). The dAT is closely related to the temperature hysteresis under consideration.

Figure 3:
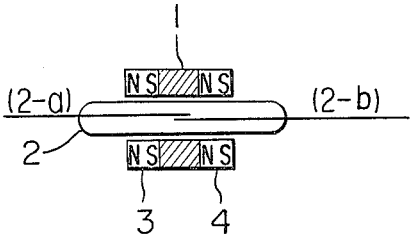
FIG. 3 is a longitudinal cross section of a thermo-sensitive reed switch of conventional type.

FIG. 3 illustrates the construction of a typical thermo-sensitive reed switch of conventional type, with thermo-sensitive ferrite being indicated as 1, reed switch element as 2, reeds as 2-a and 2-b and permanent magnets as 3 and 4. Ferrite 1 and permanent magnets 3 and 4 together constitute a tubular body. The switch so constructed operates in the manner shown in FIG. 4, of which FIG. 4(*a*) represents a state of thermo-sensitive ferrite 1 being at a temperature below the pre-set actuating temperature and keeping the contact points closed, while FIG. 4(*b*) represents another state of the ferrite 1 being at a temperature above the pre-set actuating temperature and keeping the contact points open. As temperature rises, the magnetic flux passing in the axial direction through the contact part of switch element 2 decreases and, when the flux reaches DO, the contact points open, thus changing the state of the switch from "on" to "off". Conversely, as the temperature falls, the flux through the contact part increases and, when the flux reaches PI, the contact points close to change the state from "off" to "on". Operating temperature denotes a temperature level at which the contact points open, and resetting temperature denotes another level at which the contact points close. Then, the difference between the two temperature levels is a temperature hysteresis.

It will be understood from the foregoing explanation that there is an intimate relationship between the dAT of the reed switch and its temperature hysteresis. Obviously, large temperature hysteresis can be obtained and secured in a reed switch whose dAT is large. It does not follow, however, that dAT can be made as large as one may wish and that a reed switch made to possess a dAT corresponding to the desired temperature hysteresis does not mean its availability in unlimited quantities. There is a limit to the availability of thermo-sensitive reed switches with large temperature hysteresis if the switches are specified by specifying their dAT alone.

Figure 5:
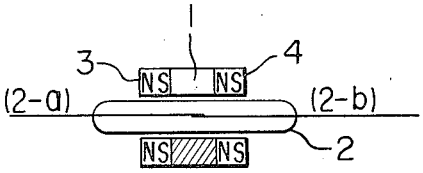
FIG. 5 is a longitudinal cross section of a thermo-sensitive reed switch embodying the present invention.
Figure 4:
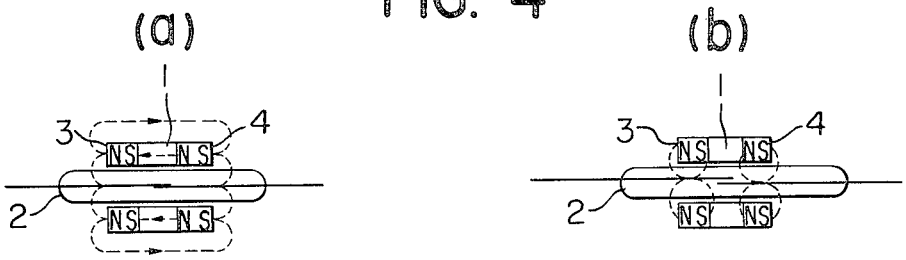
FIGS. 4(*a*) and 4(*b*) illustrate the operating principles of a conventional thermo-sensitive reed switch.
Figure 6:
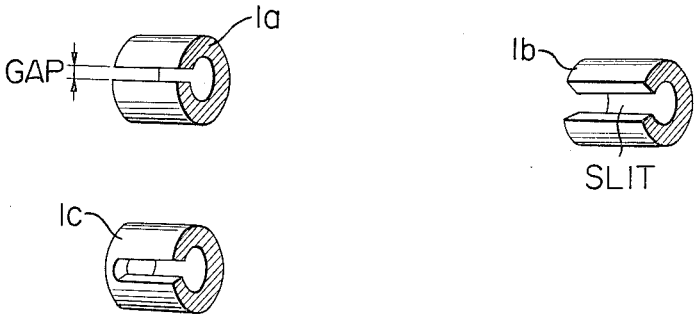
FIG. 6 shows, in perspective views, thermo-sensitive ferrite elements shaped according to this invention.
Figure 7:
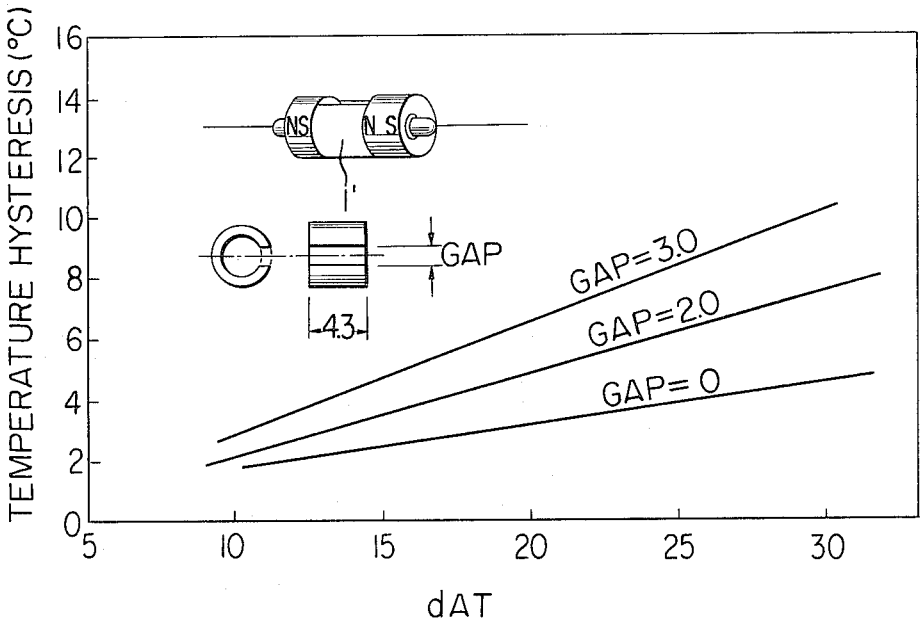
FIG. 7 illustrates characteristic curves showing the relationship between temperature hysteresis and dAT for different values of gap, taken as the parameter, in the slit of the thermo-sensitive ferrite element.

The present invention will be explained in detail by way of presently preferred embodiment indicated in FIG. 5, in which thermo-sensitive ferrite 1' is in tubular form and has a slit (shown more clearly in FIG. 6) extending parallel to the length of the reeds, whereas switch element 2 and tubular permanent magnets 3 and 4 are of the same construction as those of the conventional type. As is apparent from the drawings, the tubular permanent magnets contain no slits. Referring to FIG. 6, which shows three representative forms of ferrite element (1*a*, 1*b* and 1*c*), the thermo-sensitive ferrite has a gap corresponding to said slit. Needless to say, the ferrite element differs from the conventional tubular one in regard to the distribution and quantity of magnetic flux. In the curves of FIG. 7, the thermo-sensitive reed switch of this invention using ferrite 1', represented by two curves, GAP=3.0 and GAP=2.0 (e.g., representing two elements having gaps of 3.0 and 2.0 mm) is compared with the one using a conventional ferrite element, represented by the curve, GAP=0, with respect to dAT and temperature hysteresis. These curves show that, with dAT ranging from 20 to 25 AT, the conventional switch has temperature hysteresis of anywhere between 3.2° and 3.9° C. while a switch according to this invention has as large a temperature hysteresis as approximately 6.5° to 8.4° C. with its gap sized 3.0 mm., e.g. Such a large temperature hysteresis, moreover, can be readily secured in a switch embodying the present invention.

It will be seen from the foregoing description that, according to this invention, even with reed switch elements whose dAT is within the readily available range, thermo-sensitive reed switches with relatively large temperature hysteresis can be obtained within the allowable range of control accuracy variation by merely providing a properly sized slit. Furthermore, the tubular part, consisting of a thermo-sensitive ferrite tube element and permanent magnets, is easy to fit and install on the reed switch element (the material of the magnetic tube element may be an oriented magnetic steel or any like material whose magnetic characteristic is dependent on temperature), because the slit may be filled with a bonding compound to firmly attach the tubular part to the switch element. The shape of the thermo-sensitive magnetic element and permanent magnets is not limited to the tubular one shown in the attached drawings; it may be a square or any other shape in cross section as long as the element and magnets surround the switch element. Thermo-sensitive switches according to this invention are suited to mass production and therefore are high in industrial value.

The invention is defined by the following claims.

We claim:

1. In a thermo-sensitive reed switch that includes a reed switch element having at least two magnetic reeds surrounded by a tubular enclosure, a thermo-sensitive magnetic element located on said tubular enclosure near the contacting portions of said reeds, and at least two permanent magnets attached to each end of said magnetic element and similarly polarized endwise and alongside of said reeds, the improvement wherein said thermo-sensitive magnetic element is slit therein in a portion thereof adjacent to said magnetic reeds, and wherein said permanent magnets contain no slits.

2. The thermo-sensitive reed switch of claim 1, in which said slit extends generally parallel to said reeds.

3. The thermo-sensitive reed switch of claim 1, or 2, in which said slit extends within said thermo-sensitive magnetic element from one end thereof adjacent one permanent magnet to the other end thereof adjacent the other permanent magnet.

4. The thermo-sensitive reed switch of claim 3, in which said slit terminates within said thermo-sensitive magnetic element adjacent an end thereof.

5. The thermo-sensitive reed switch of claim 1, in which said two permanent magnets are attached to opposite ends of said thermo-sensitive magnetic element, and said slit is provided in a portion of said thermo-sensitive magnetic element adjacent to said two permanent magnets.

6. The thermo-sensitive reed switch of claim 1 or 2, in which said thermo-sensitive magnetic element and said permanent magnets generally surround said enclosure.

* * * * *